US005377503A

United States Patent [19]

Reedy et al.

[11] Patent Number: 5,377,503

[45] Date of Patent: Jan. 3, 1995

[54] CONVERTIBLE TOP SINGLE PACKAGE HEAT PUMP UNIT

[75] Inventors: Wayne R. Reedy, Edwardsville, Ill.; Lawrence J. Boyce, St. Louis, Mo.

[73] Assignee: Nordyne, Inc., St. Louis, Mo.

[21] Appl. No.: 108,508

[22] Filed: Aug. 18, 1993

[51] Int. Cl.[6] ..... F24F 13/02; F25B 27/00

[52] U.S. Cl. ..... 62/326; 165/76; 165/137; 312/236; 62/298; 62/404

[58] Field of Search ..... 62/77, 298, 326, 324.1, 62/404; 165/137, 76; 312/236

[56] References Cited

U.S. PATENT DOCUMENTS

| | | | |
|---|---|---|---|
| 2,118,328 | 5/1938 | Roland | 165/137 |
| 2,690,654 | 10/1954 | Graham | 62/326 |
| 3,174,541 | 3/1965 | Brandt et al. | 165/137 |
| 3,357,763 | 12/1967 | Toper | 62/298 |
| 3,678,993 | 7/1972 | Pierce | 165/76 |
| 3,742,725 | 7/1973 | Berger | 62/419 |
| 4,072,187 | 2/1978 | Lodge | 165/48 |
| 4,554,796 | 11/1985 | Stankard | 62/326 |
| 4,646,817 | 3/1987 | Van Ee | 167/76 |

*Primary Examiner*—Henry A. Bennet
*Assistant Examiner*—William C. Doerrler
*Attorney, Agent, or Firm*—Harris Beach & Wilcox

[57] ABSTRACT

A single package heat pump unit is field-reconfigurable from a horizontal discharge configuration to a top discharge configuration. A supply panel covers the top and upper part of the back wall, and contains a supply vent in a vent wall, with a blank wall joining it at a ninety degree crease. The supply panel can be removed and installed in the top discharge position, using standard fasteners.

5 Claims, 4 Drawing Sheets

CONVERTIBLE TOP SINGLE PACKAGE HEAT PUMP UNIT

BACKGROUND OF THE INVENTION

This invention is directed to heating, ventilation, and air conditioning equipment. The invention is more particularly directed to a single package heat pump or single package air conditioning system, in which the outdoor fan, outdoor coil, compressor, indoor air coil, and indoor circulation air blower are all contained in a single cabinet or housing that is mounted on an exterior wall of a structure, and has supply and return ducts that communicate, through penetrations in the exterior wall, with room air in a comfort zone within the structure.

The cabinets of these units are provided with a return duct in a rear wall that connects with ductwork that leads from the interior of the structure, and a supply duct in the rear wall that connects to supply ductwork that passes into the interior. Room air enters the return duct and is brought into the cabinet. There, the air is treated, i.e., cooled and dehumidified, or heated and humidified, as appropriate, and is blown by a circulation blower back through the supply duct into the comfort space inside the building structure. Because the units are built for horizontal discharge, they are not easily reconfigured for top discharge. However, in many instances, discharge of supply air vertically from the top of the unit better suits a particular installation. In that case, the cabinet must be factory reconfigured or specially ordered and constructed.

Also, if a unit of this type is reconfigured from horizontal discharge to top discharge, or vice versa, the cabinet has to be made resistant to rain and weather.

OBJECTS AND SUMMARY OF THE INVENTION

It is an object of this invention to provide a single package heat pump or air conditioner unit that can be easily reconfigured in the field from horizontal discharge to top discharge.

It is another object to provide a single package heat pump or air conditioner unit with a cabinet that converts between horizontal and top discharge simply by removing and reinstalling a panel that is secured with ordinary fastening devices.

According to one aspect of this invention a single package heat pump unit is provided with a reversible supply duct panel that permits the unit to be reconfigured from a horizontal discharge to a vertical discharge configuration by the installer without having to alter or adjust any of the internal components. The term "single package" means that all of the heat exchangers coils, the blowers, and the compressor are contained in one cabinet or housing, and the indoor air is fed to it through a return duct. The conditioned air is discharged back to the interior space or comfort space through a supply duct. The term "heat pump" is meant to include not only a fully reversible system that can be used for heating or cooling, but also an air conditioning unit which cools or dehumidifies the room air. In some of these units a resistive type electric heater is used to heat the room air.

The cabinet has a back wall that mounts against an exterior wall of the building. The supply and return ducts communicate through penetrations in the building wall with the room air in the comfort space. A room air heat exchanger in the cabinet heats or cools the air that flows through the return duct. Then, a blower situated above this heat exchanger discharges the treated air out through the supply duct back into the comfort space.

The supply duct is located in a panel that has a blank wall portion and a duct wall portion (where the supply duct is formed) that meet at a right angle bend or crease. These two wall portions are rectangular and of the same size, so that either one can be situated on top of the cabinet with the other on the back. The top and back of the cabinet each are open to define a corner opening that this supply duct panel fits. The periphery of the panel has right angle flanges directed inwards. The back wall of the cabinet has a lower portion that ends at a transverse top edge. At this top edge there is a L-shaped flange with a first portion that extends towards the front wall and a second portion that rises from the front edge of the first portion. This construction creates a weather resistant joint with the lower edge of the duct panel in either configuration.

The above and many other objects, features, and advantages of this invention will become apparent from the ensuing description of a preferred embodiment as disclosed in the ensuring specification, which should be read in conjunction with the accompanying Drawing.

DETAILED DESCRIPTION OF THE PREFERRED EMBODIMENT

Figure 2:
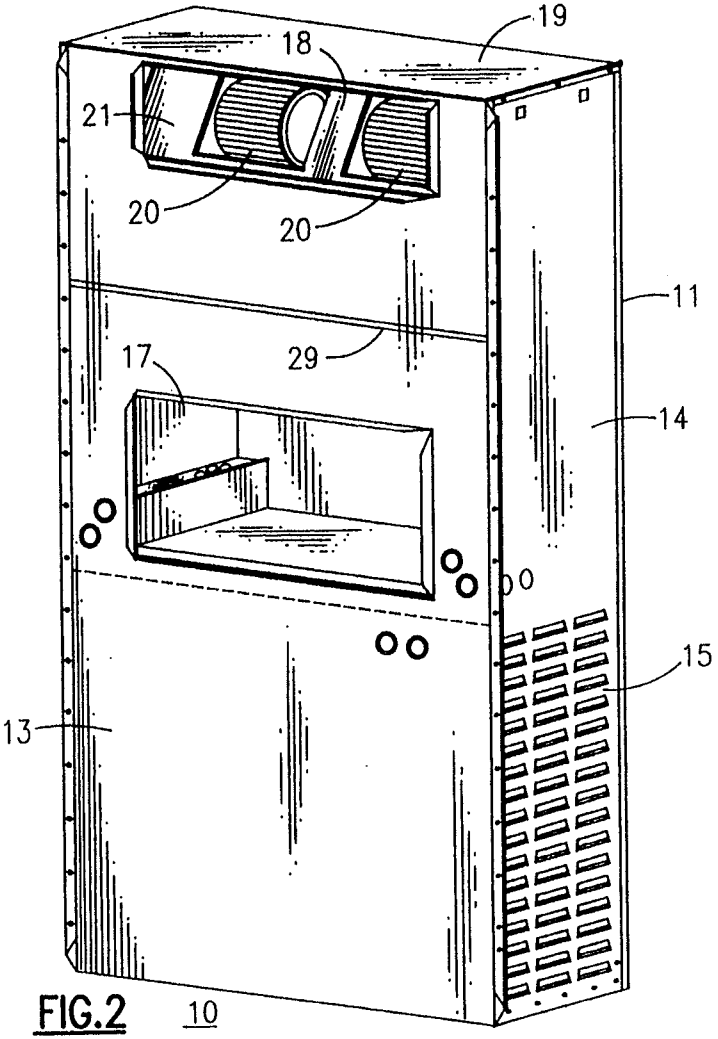
FIGS. 2 and 3 are rear prospective views of the unit of this embodiment, shown in a horizontal discharge configuration and a top discharge configuration, respectively.
Figure 1:
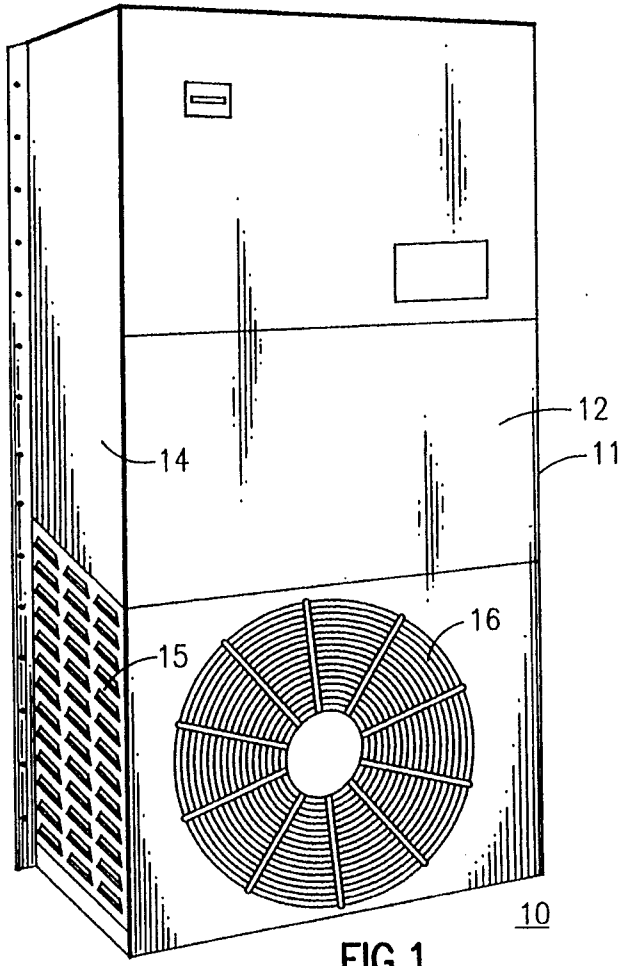
FIG. 1 is a front perspective view of a single package heat pump unit of one embodiment of this invention.

With reference to the Drawing, initially to FIGS. 1–5, a single package heat pump unit 10 is shown with a housing or wrapper 11 having a front wall 12 (FIG. 1) and a rear wall 13 (FIG. 2) as well as side walls 14. In the lower part of the side walls 14, there are louvers 15 and there is a blower 16 for outside air located in the lower part of the front wall 12. The outdoor coil and the compressor for the unit 10 are contained within the lower half of the wrapper 11, and are not shown. These elements serve to discharge waste heat to the outside environment or to absorb heat from the outside environment. The upper half of the wrapper contains the indoor air handling equipment, including an indoor coil and circulation blowers. As shown in FIG. 2, the return air vent 17 is formed at a center part of the rear side wall 13. A supply vent 18 is situated at the top of the unit 10 and serves to send conditioned air from the unit through a penetration back into the room space. In this embodiment, a supply panel 19, here fastened to the top of the wrapper 11 includes the supply vent 18 formed in it. Circulation air blowers 20 are mounted in a circulation blower mounting plate 21. These are visible in FIG. 2 through the supply vent 18.

FIG. 2 illustrates the rear or horizontal discharge configuration of the unit 10, in which the supply air, i.e., the conditioned air is passed through a wall penetration adjacent to the top part of the unit 10.

Figure 3:
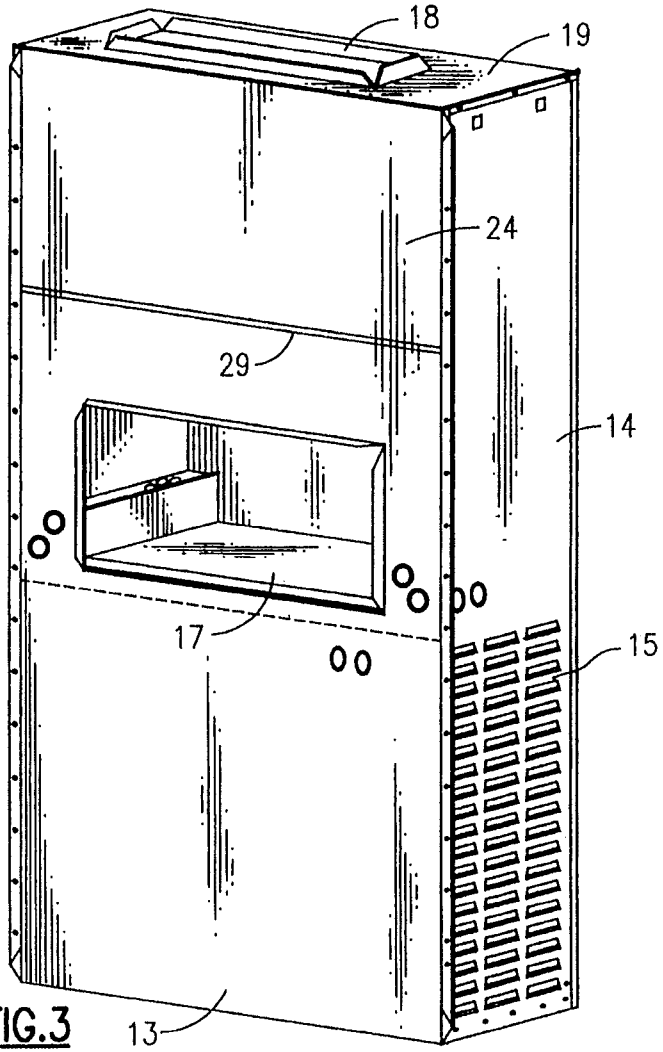

FIG. 3 illustrates a top discharge configuration. In configuration the conditioned air is discharged through the top of the wrapper 11 into a penetration above the unit to return to supply the conditioned air into the building. The unit 10 is field reconfigurable between the horizontal discharge configuration and the top discharge configuration by simply removing and reinstalling the panel 19.

Figure 4:
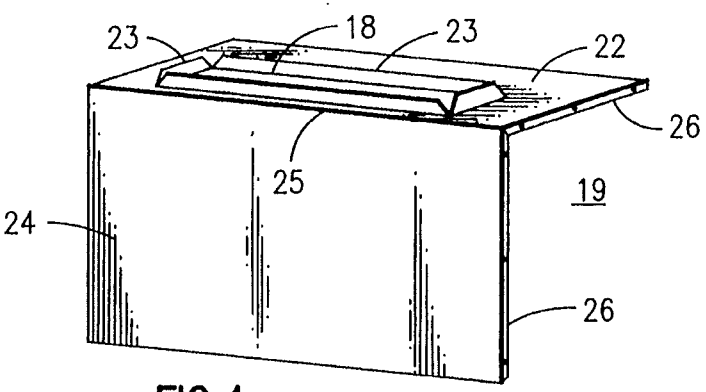
FIGS. 4 and 5 are perspective views of the outside and inside of the supply duct panel of this embodiment.
Figure 5:
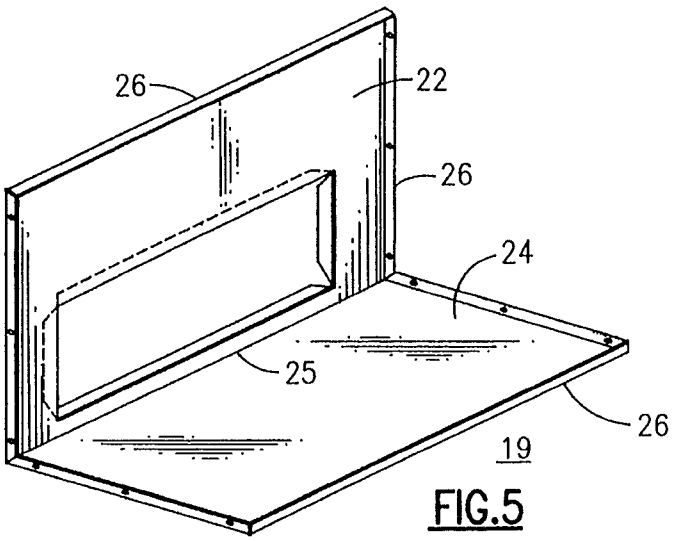

As shown in FIGS. 4 and 5, the supply panel 19 has a vent wall 22 in which the supply vent 18 is formed, here with bent metal flanges 23 surrounding the vent opening. The panel 19 also has a blank wall 24, which serves as the top wall in the horizontal charge configuration of FIG. 2. The blank wall 24 serves as the back wall in the vertical or top discharge configuration of FIG. 3. The vent wall and blank wall 22, 24 are of the same length and width. This permits the unit 10 to be reconfigured in the field from the horizontal or back discharge configuration of FIG. 2 into the top discharge configuration of FIG. 3 simply by removing the panel 19 and reinstalling it in the other orientation. The blank wall 24 and the vent wall 22 meet at a ninety-degree crease or bend 25. A ninety-degree peripheral flange 26 continues around all of the transverse outer edges and side edges of the two walls 22, 24. This peripheral flange 26 has clearance openings to receive threaded fasteners, i.e., machine screws.

Figure 6:
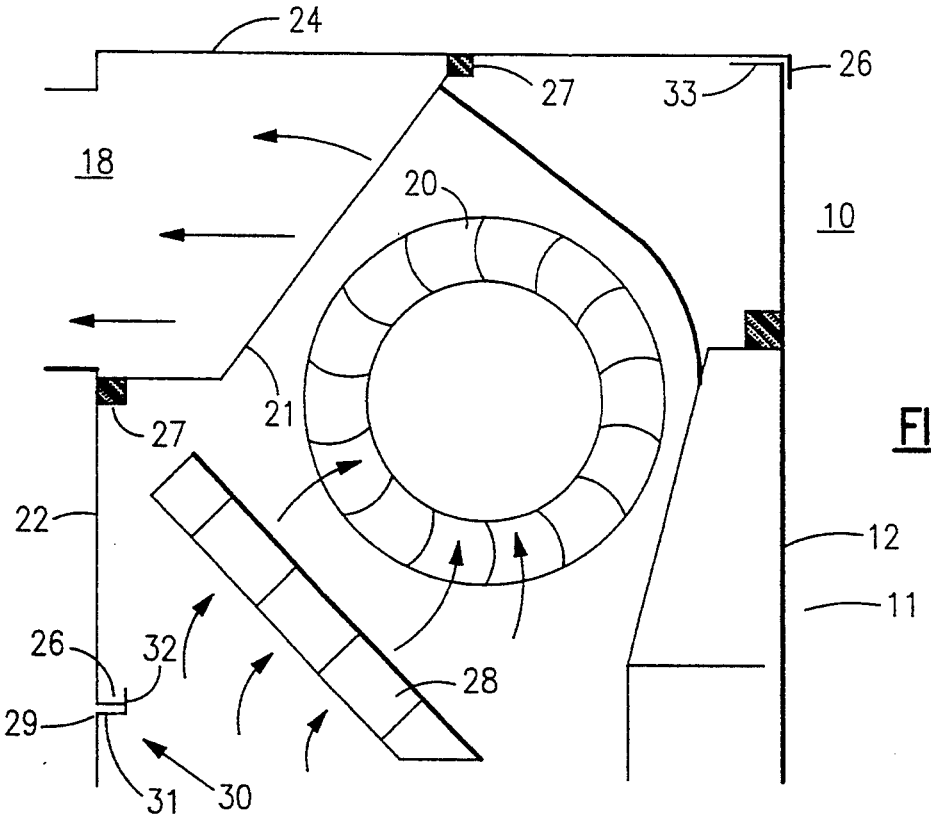
FIGS. 6 and 7 are schematic partial elevations of an upper or discharge portion of the unit, showing the horizontal discharge and vertical discharge configuration, respectively.
Figure 7:
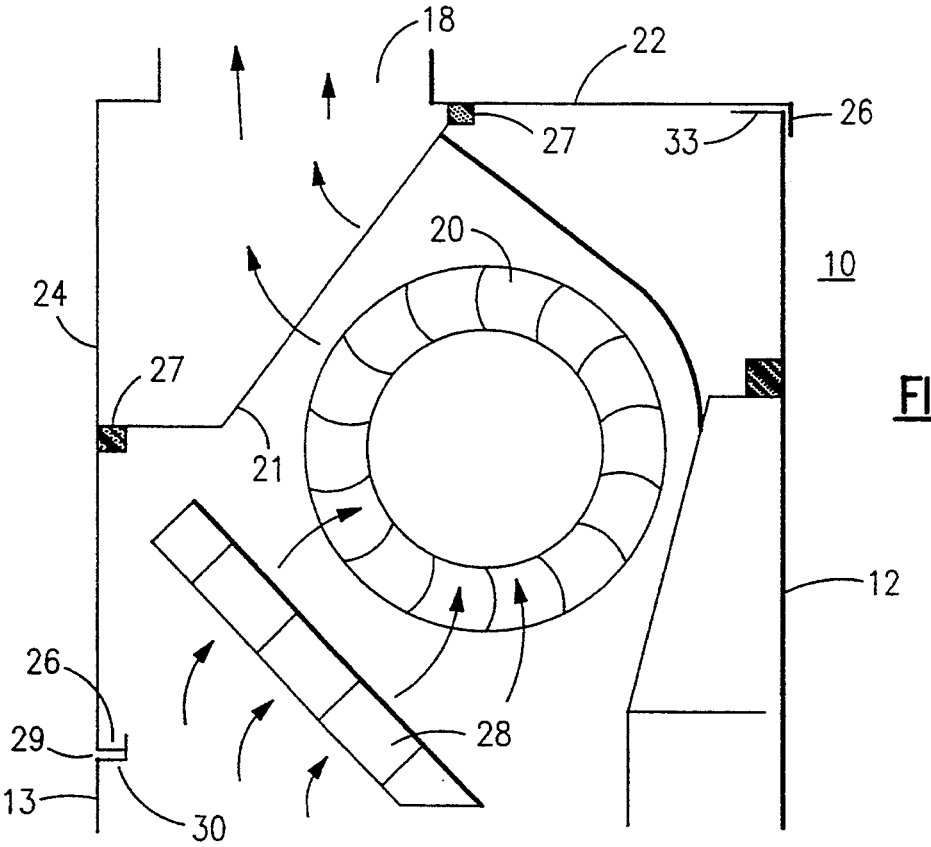

FIGS. 6 and 7 are schematic cross-sectional elevations showing the top part of the unit 10. Here the supply panel 19 is shown attached over the front wall 12 onto the side wall 13 of the rear side wall 13 of the unit wrapper 11. FIG. 6 illustrates the horizontal discharge configuration, in which the blank wall 24 of the panel 19 forms the top of the wrapper 11. In FIG. 7 which illustrates the top discharge configuration, the vent wall 22 forms the top of the wrapper 11. Disposed beneath the panel 19 are the blowers 20 and blower mounting plate 21. The blower mounting plate 21 extends diagonally between the back and the top of the unit, forming a triangular discharge chamber that contains the supply vent 18 in either the horizontal or top discharge configuration. Packing material 27 is employed to form seals against the panel 19 so that the exhaust of the blower 20 exits through the supply vent 18 and is not recirculated within the unit. An indoor coil 28, i.e., an evaporator coil in the case of air conditioning, is situated within the unit below the blowers 20. An intake chamber, defined below the coil 28 and above the return vent, is not shown in these views.

At an upper horizontal edge 29 of the rear side wall 13, there is an L-shaped flange 30 formed of a horizontal member 31 that projects forward and a vertical member 32 that rises from the forward edge of the horizontal member 31. The peripheral flange 26 at the outer edge of the supply panel vent wall 22 (FIG. 6) or the supply panel blank wall 24 (FIG. 7) fits into this L-shaped flange 30 and prevents rain or other moisture from entering the unit 10.

At the top of the front side wall 12 there is a rearwardly directed flange 33. The top panel wall 22 or 24 and its associated peripheral flange 26 rests on this and extends down over it to form a weather proof fitting, as shown in both FIGS. 6 and 7.

Figure 8:
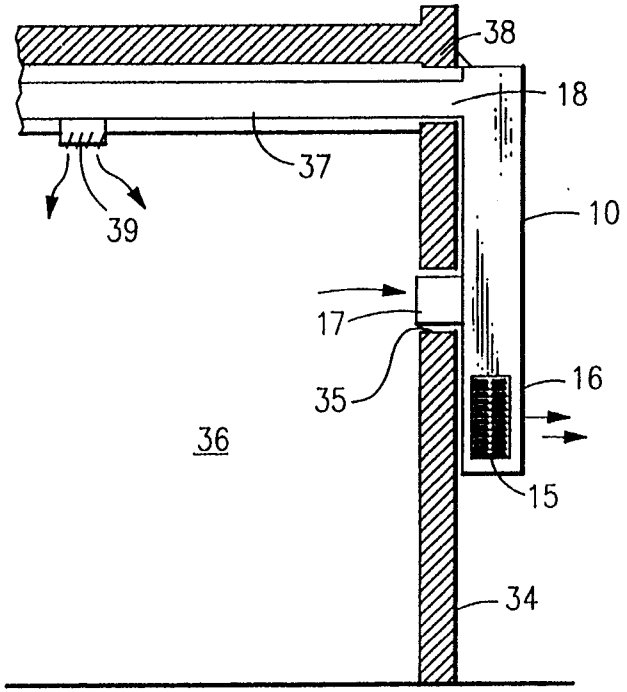

FIG. 8 illustrates the installation of a package heat pump unit. Here the unit 10 is mounted on an external wall 34 of a building. Room air passes as received into the return air duct 17 through a penetration 35 from a comfort space 36 within the building. Supply ducting 37 extends from the unit 10 through a penetration 38 above the return air penetration 35, and connects to air registers 39, here shown above a false ceiling, to supply cool, dehumidified air during hot weather, or warm, air during cool weather, to the comfort space.

Figure 9:
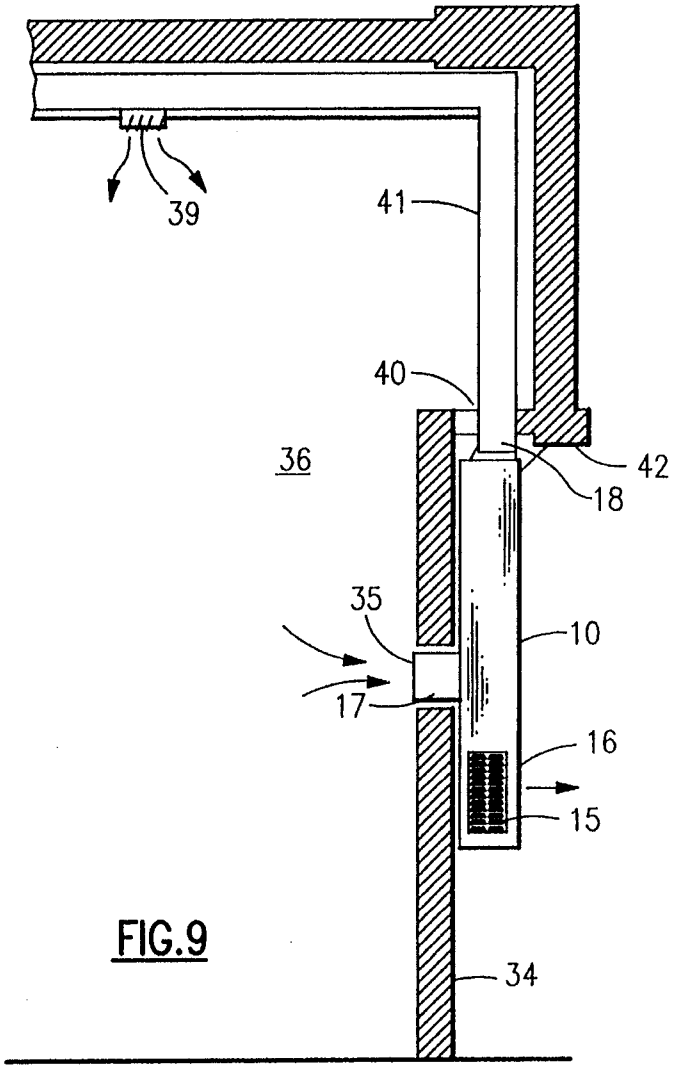
FIGS. 8 and 9 are respective installation views of the single package heat pump unit in horizontal discharge and top discharge configurations, respectively.

FIG. 9 shows the installation of the unit 10 where the top discharge configuration is employed. Here, the single package heat pump unit 10 is mounted on an external wall 34 as in FIG. 8, and similarly receives return air through a penetration 35 in the wall 34. However, in this configuration, the conditioned air conducted is supplied to a vertical duct 41 that carries the conditioned air vertically through a penetration 40 into a soffet 42, i.e., an overhang, in the external wall 34. Thereafter the supply duct carries the air to ceiling registers 39.

The term "heat pump", as employed in the above description and in the following claims, is meant to cover units which provide cooling only, as well as those that provide both heating and cooling. The term is also meant to cover air conditioning units which provide cooling, but also include a resistive electric heater or similar heating means.

A packing or weather seal is employed around all of the penetrations 35, 38, 40, through the external wall 34.

The unit of this invention can be readily reconfigured from in the field by the installer, by simply removing the associated screw fasteners from the panel 19, and changing the orientation of the panel, and then reinstalling the screw fasteners. The diagonally extending blower mounting panel 21 allows the blowers 20 to communicate with the supply vent 18 in either of the top discharge or horizontal discharge configurations.

While not shown here, an access panel on the front wall 12 provides user access for filter changes and other adjustments. Various knockouts and access apertures in the rear wall and side walls permit power, drain, and thermostat connections.

While this invention has been described in detail with reference to a preferred embodiment, it should be understood that the invention is not limited to that precise embodiment. Rather, many modifications and variations would present themselves to those skilled in the art without departing from the scope and spirit of this invention, as defined in the appended claims.

What is claimed is:

1. Single package heat pump unit that comprises a cabinet that mounts onto an exterior wall of a structure and includes a return air duct in a back wall of the cabinet that communicates through a penetration in said exterior wall with room air in a comfort space within said structure, and a supply duct positioned on one of a top wall and said back wall of the cabinet to communicate through a penetration in said structure with said comfort space to supply treated air thereto; a room air heat exchanger within said cabinet for treating room air that flows into said cabinet through said return air duct; blower means in said cabinet for discharging the treated air out through said supply duct to said comfort space; and outdoor heat exchange means in said cabinet for exchanging heat with an outdoor environment; wherein said cabinet includes a reversible supply duct panel that has one blank wall portion and one duct wall portion containing said supply duct, and means permitting removable attachment of the supply duct panel onto the cabinet in either of two configurations including a horizontal discharge configuration in which the blank wall portion of the panel is disposed on the top of the cabinet and the duct wall portion is disposed on the back of the cabinet, and a top discharge configuration in which the duct wall portion is disposed on the top of the cabinet and the blank wall portion is disposed on the back of the cabinet.

2. The single package heat pump unit of claim 1 wherein said blank wall and said duct wall are equal in length and width and are joined at a right angle crease.

3. The single package heat pump unit of claim 2 wherein said blank wall portion and said duct wall portion each have side edges and a transverse edge parallel to said crease, with respective flanges extending at right angles at each of the side and transverse edges.

4. The single package heat pump unit of claim 1 wherein said cabinet includes a front wall having a transverse flange across a top edge thereof and directed rearwards, and said back wall has a lower portion with a transverse top edge adjacent said panel with an L-shaped flange at said top edge; said flange having a first portion that extends toward the front wall and a second portion that rises from a front edge of the first portion.

5. The single package heat pump unit of claim 1 wherein said blower means includes at least one blower mounted in a blower mounting plate that extends diagonally between the top and back walls of the cabinet.

* * * * *